United States Patent [19]

Moore

[11] 3,988,964

[45] Nov. 2, 1976

[54] GAS OPERATED FIREARM WITH METERING ADJUSTMENT

[76] Inventor: Wildey J. Moore, Box 578, Rte. 94, R.D. 4, Newburgh, N.Y. 12550

[22] Filed: Apr. 25, 1974

[21] Appl. No.: 463,849

[52] U.S. Cl. ..... 89/185; 89/191 A; 89/193

[51] Int. Cl.[2] ..... F41D 5/08

[58] Field of Search ..... 89/14 R, 14 E, 128, 89/185, 191 A, 193

[56] References Cited

UNITED STATES PATENTS

| | | | |
|---|---|---|---|
| 1,802,816 | 4/1931 | Holek | 89/193 |
| 1,892,141 | 12/1932 | Garand | 89/193 |
| 2,211,405 | 8/1940 | Browning | 89/191 A |
| 3,273,460 | 9/1966 | Mason | 89/191 A |
| 3,329,064 | 7/1967 | Segrest | 89/128 |
| 3,382,766 | 5/1968 | Seiderman | 89/193 |
| 3,443,477 | 5/1969 | Kaempf | 89/128 |
| 3,611,867 | 10/1971 | Silsby | 89/14 R |

*Primary Examiner*—Stephen C. Bentley
*Attorney, Agent, or Firm*—McCormick, Paulding & Huber

[57] ABSTRACT

A gas operated firearm capable of at least semi-automatic operation, the firearm including a receiver having a barrel connected thereto, the barrel including a bore with a plurality of radially extending ports through the barrel from the bore. A breach bolt is mounted for reciprocation in the receiver and is adapted for abutting registration in a first position with the cartridge chamber, and includes a locking lug for maintaining the bolt in position abutting the cartridge, when the cartridge is in the chamber. A slide is mounted for reciprocation on the receiver and includes a camming surface which cooperates with the cam on the bolt for unlocking the bolt and effecting reciprocation of the bolt in the receiver upon the slide being drawn to the rear of the firearm. An annular piston registers with the terminal forward end of the slide, the piston circumscribing the barrel and being slidably mounted for movement therealong, the skirt portion of the piston being spaced radially from the barrel and overlying the gas ports in the barrel. A gas flow adjuster or sleeve is mounted for axial displacement along the barrel to, if desired, at least partially cover the ports, thereby permitting metering of the flow of gas to the piston, or restrict such flow entirely if single shot operation is desired, when operating the firearm.

9 Claims, 4 Drawing Figures

GAS OPERATED FIREARM WITH METERING ADJUSTMENT

The purpose of this abstract is to enable the public and the Patent Office to determine rapidly the subject matter of the technical disclosure of the application. This abstract is neither intended to define the invention of the application nor is it intended to be limiting as to the scope thereof.

SUMMARY OF THE INVENTION AND STATE OF THE PRIOR ART

The present invention relates to gas operated firearms capable of at least semi-automatic operation; and more particularly relates to improvements in such firearms wherein the gas flow to the operating mechanism which creates the necessary movement for cartridge extraction and ejection, cocking of the hammer, and recharging of the chamber with a fresh round from the clip, may be adjusted.

As is well known most semi- and full-automatic shoulder arms, with the single exception of submachine guns, are gas operated. Most of the world's auto-loading shotguns, rifles, and machine guns are powered by expanding propellent gas taken from the cartridge. However, no one has ever produced a commercially successful gas-operated automatic (auto loader) handgun even though several have tried. Recently, however, a gas operated pistol design has been developed by F.F.V. which is particularly adapted to handle higher power cartridges with a much lower recoil than believed possible heretofore, and by a pistol of a weight which is approximate to the weight of more conventional handguns. Such a gas operated automatic (auto loader) is described at page 46 of the "Shooting Times" May 1973 Issue, and on page 38 et seq. of the May 1973 "Guns and Ammo" magazine.

In all of the weapons that are designed as gas operated, even the relatively new gas operated auto loader or pistol described above, and not excluding such weapons as an M-1 rifle, a Remington 1100 shotgun or even a BAR, it is difficult and sometimes dangerous, depending upon the design of the weapon, to use a more powerful load in the weapon than that for which it was designed. Additionally, if a weaker charge cartridge is being used in the weapon, as for example for target practice or the like, the firearm may malfunction because of insufficient gas pressure to enable proper ejection of the spent cartridge, cocking of the hammer and placement of a fresh cartridge into the chamber for the next round to be fired. What's more, it is difficult if not impossible in state of the art gas operated firearms, to selectively cut off the gas operation so that the weapon may be operated as, for example, a single shot target firearm.

In view of the above, it is a principal object of the present invention to provide a gas operated firearm capable of at least semi-automatic operation, wherein the gas operation may be adjusted to effect proper automatic operation of the firearm under varying cartridge load conditions.

Another object of the present invention is to provide a novel gas operated mechanism for a firearm in which the gas mechanism may be rendered entirely inoperative so that the firearm may be fired in single shot fashion and used as a target weapon.

Still another object of the present invention is to provide an adjustable gas operated firearm which permits interchangeability of parts such that various caliber firearms may be produced with a minimal change in parts, thereby reducing the cost of manufacture.

Other objects and a more complete understanding of the invention may be had by referring to the following specification and claims taken in conjunction with the accompanying drawings in which:

Figure 1:
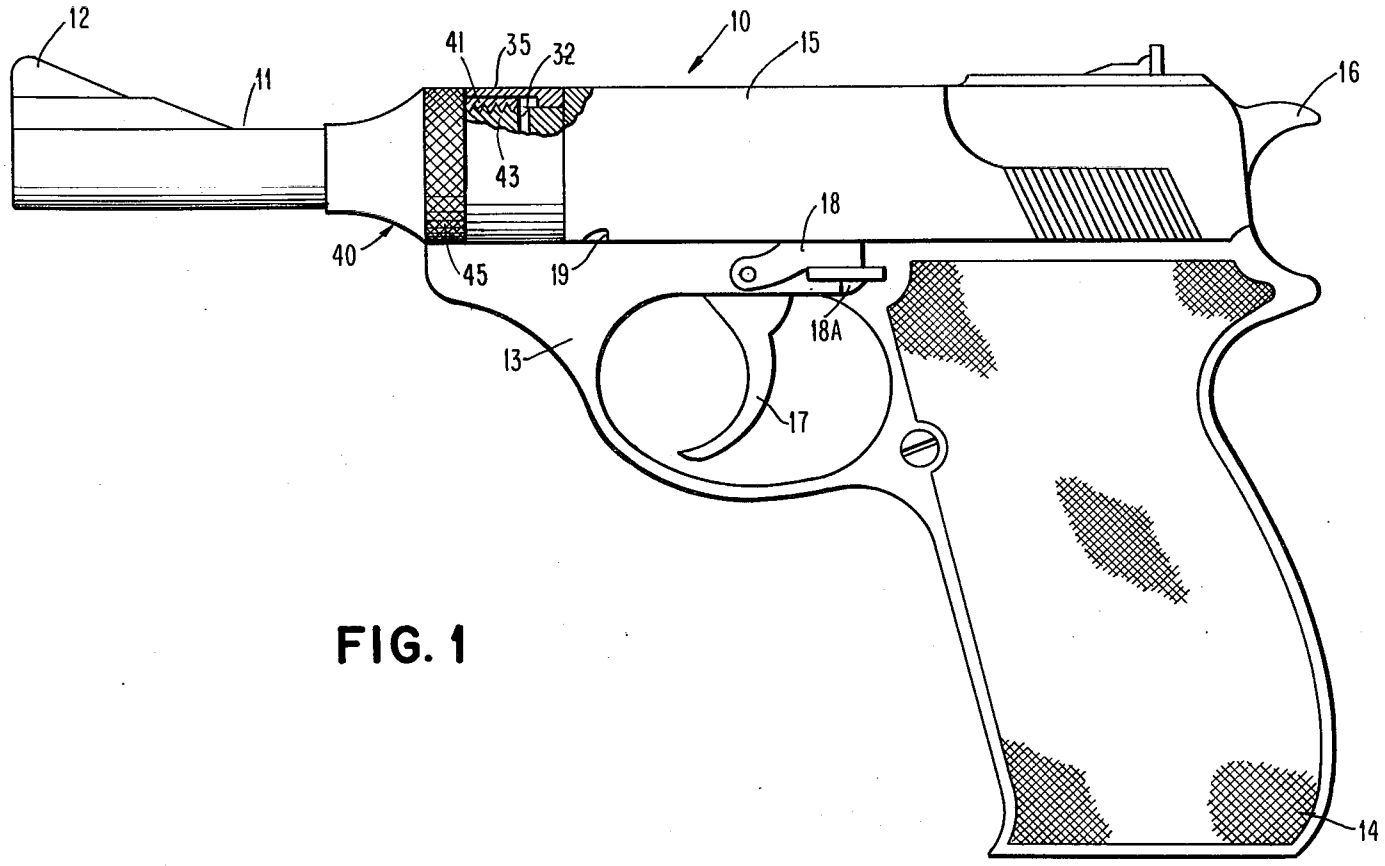
FIG. 1 is a fragmentary side elevational view of a gas operated automatic (auto loader) embodying apparatus constructed in accordance with the present invention.

Referring now to the drawings, and especially FIG. 1 thereof, a gas operated firearm capable of at least semi-automatic operation is shown therein. In the illustrated instance the firearm comprises a pistol 10 including a barrel 11 having a standard fixed front sight 12 thereon, the barrel being connected to a receiver 20 (see FIG. 2) which is mounted on a grip frame 13. As is standard, the grip frame 13 includes a grip or stock 14 interiorly of which is the standard clip or magazine (not shown). Mounted for reciprocation on the receiver is a slide 15 and, in the illustrated instance, an exposed hammer 16. The hammer operates in the conventional manner with trigger 17 and its associated mechanism (not shown). A standard safety catch 18 and slide retainer 18A, which operates in conjunction with a notch 19 in the slide, serves to hold the slide in its rearward position for firearm disassembly and for checking the action of the pistol.

As is conventional, the barrel of the pistol includes a bore 11A having helical lands 11B and grooves 11C therein, the barrel having a muzzle end 12A and a chamber end 12B for receiving a cartridge therein. The barrel is, in the preferred manner, rigidly secured to the receiver 20 as, in the illustrated instance, by screw threads or the like 21 which mate with existing screw threads 21A in the receiver.

Figure 4:
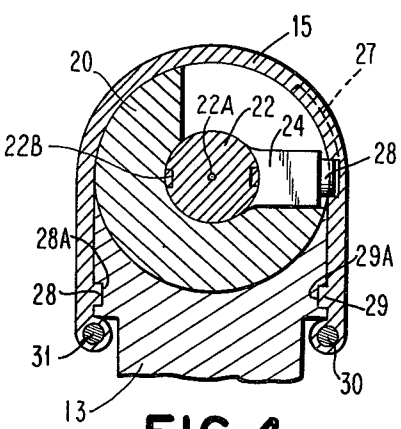
FIG. 4 is a fragmentary sectional view taken along line 4—4 of FIG. 2.

In order to provide necessary firing of a cartridge in the chamber 12B of the weapon, a breach bolt 22 is mounted for reciprocation in a bore 23 in the receiver 20. The breach bolt includes a conventional firing pin 22A as well as extractor mechanism 22B for firing a cartridge in the chamber and extracting the same for ejection of the spent cartridge, in a conventional manner, through a suitable aperture in the side of the slide (not shown). The breach bolt 22 includes a laterally extending lug 24 (see FIG. 4) which locks the bolt in a vertical slot 25 in the receiver 20. The slot 25 in conjunction with the lug 24 serves to maintain the breach bolt in abutting relationship with a cartridge in the chamber upon actuation of the firing mechanism. Thus in order to bring into play the conventional extractor mechanism for removing the spent cartridge from the chamber, and rearming the pistol as well as providing a fresh cartridge into the chamber by bolt reciprocating in the bore 23, the lug 24 must be moved upwardly in the slot 25 and then rearwardly along a slot 26 in the receiver.

The operation of the breach bolt 22 and the means by which the bolt is unlocked to provide for its rearward motion along the slot 26 in the receiver 20 is accomplished by the rearward movement of the slide 15 in a manner which will be more fully explained hereinafter. Suffice at this point in the description that the rearward movement of the slide, the slide being provided with a cam slot 27 therein which engages a cam follower 28 on the lug 24, causes elevation of the lug 24 and unlocking of the breach bolt 22. Further rearward motion by the slide affects rearward movement of the breach bolt along the bore 23 for rearming of the firearm.

In accordance with the invention, the firearm is capable of gas operation by gas pressure against the slide being applied adjustably with the same magnitude regardless of the charge carried by the cartridge. To this end, and referring to FIG. 4, the slide 15 is generally U shaped in cross section and includes guides 28 and 29 which cooperate with guide ways 28A, 29A in the frame 13. As is conventional, the slide is kept in its home or battery position, that is to the left (reference FIG. 2) as by conventional recoil springs and rods 30 and 31. As illustrated best in FIGS. 2 and 3, the barrel 11 includes a plurality of apertures or ports 32 in the grooves 11C thereof which extend radially outwardly through the barrel, the ports being located forward of the chamber 12B so that as the projectile moves past the ports gas will move radially outward through the ports 32 and there engage an annular piston 33, the piston having a head end portion 34 which circumscribes the barrel 11 and is slidably mounted therealong. A cylindrical skirt portion 35 extends axially from the head end portion and is spaced from the barrel 11 overlying the ports 32, the head end of the annular piston being normally engageable with the terminal end 15A of the slide 15 (see FIG. 2).

In order to open or close the ports 32 a desired amount depending upon the pressure exerted by the exploding powder charge extending through the ports 32 and against the piston, so that regardless of the charge utilized in the cartridge the piston sees the same pressure for moving the slide rearwardly, gas flow adjuster means 40 are mounted for axial displacement along the barrel, the gas flow adjuster acting as a cover which is capable of registry with the port openings or in the alternative leaving the ports open for maximum gas flow and exposure to the piston 33. To this end, the gas flow adjuster 40 comprises a sleeve 41 which is coupled as by threads 42 onto mating threads 43 on the periphery of the barrel 11. The sleeve 41 has a radially extending shoulder portion 44 which abuts the skirt 35 of the annular piston 33, and serves as a forward stop for the piston. The circumferentially extending raised portion or flange 45 may be provided with a knurled surface or other easy gripping surface for the weapon operator, and is preferably provided with positional locking means, in the present instance a detent 46 including a spring loaded ball 47 at one end thereof which cooperates with recesses 48 in the raised portion 45. In this manner an indication of the position of the terminal end 50 of the sleeve 41 will be known by the weapon's operator. The flange 45 may be provided with suitable indicia to indicate the degree of opening of the ports 32 depending upon the load or charge of the cartridge being used. As shown, the detent may be conveniently positioned in the grip frame 13. It should be recognized that any convenient method of providing for displacement of the gas flow adjuster axially of the barrel while holding it firmly in position may be utilized, and the invention is not limited to the use of screw threads for providing such adjustments.

In operation, assuming first that a lightly loaded cartridge is to be employed, the port opening into the chamber 51, defined by the skirt 35 of the piston 33 and the terminal end 50 of the gas flow adjuster sleeve, would be open to permit maximum gas flow into and against the piston 33. As the cartridge is fired, the rearward thrust of the cartridge is imparted against the breach bolt 22 and upon the projectile passing the ports 32, full gas pressure is applied against the piston 33 applying rearward pressure to the slide 15. As the slide moves rearwardly, the cam slot 27 being in engagement with the cam follower 28 on the lug 24, causes the lug to move upwardly in the slot 25 and rearwardly along the slot 26 for extraction of the spent casing and ejection thereof as well as rearming of the weapon in a conventional manner. The slide then moves forward as by the recoil springs and a fresh cartridge is injected into the chamber. As the slide moves forward, the cam 27 on the slide acts in the reverse manner on the cam follower 28, causing the breach bolt, with a cartridge in the bore 23, to be moved forwardly into the chamber 12B of the barrel 11. The firearm is then capable of being once again actuated.

If, on the other hand, the cartridges to be fired contain a heavy powder charge, the gas flow adjuster may be displaced by the firearm operator, in the present instance (with reference to FIG. 2), towards the right to create a throttling action with regard to the ports 32 throttling the volume of gas into the chamber 51 and thereby reducing the charge pressure exposed to the piston 33 so that the slide and associated receiver mechanism takes no more pressure or force than with a lightly loaded cartridge. If the firearm is to be used, for example, in single shot match type competition, it is a simple matter to adjust the gas flow adjuster sleeve so that the ports 32 are entirely covered by the sleeve 41 of the adjuster, and in this manner the automatic action of the slide is prevented. Thus rearming of the firearm must be accomplished, in that event, manually.

Figure 2:
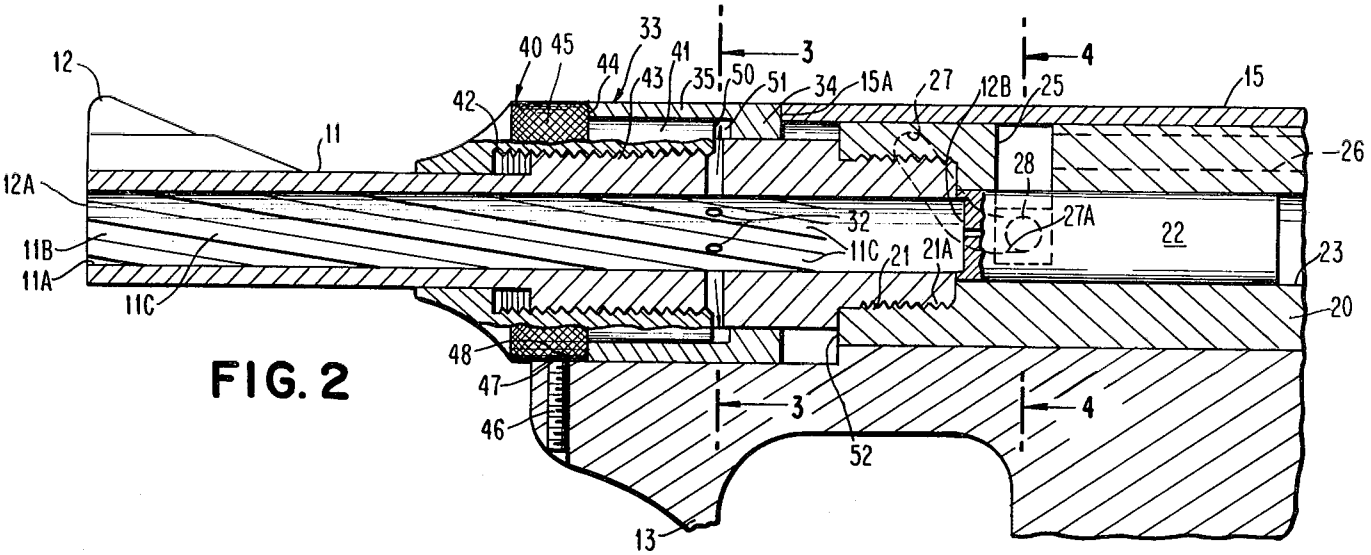
FIG. 2 is an enlarged fragmentary sectional view of a portion of the apparatus illustrated in FIG. 1.
Figure 3:
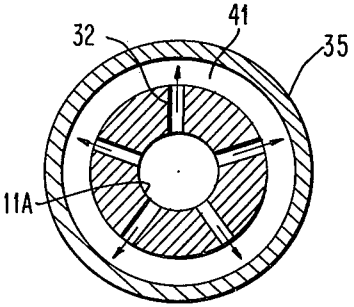
FIG. 3 is a sectional view taken along line 3—3 of FIG. 2.

It should be recognized that the cam slot 27 associated with the slide 15, and as shown in FIG. 2, has an axial or lost motion portion 27A which permits of some rearward motion of the slide 15 before unlocking of the breach bolt 22 occurs. With very heavy powder loads or large caliber heavily charged cartridges, such lost motion is desirable to help lessen the recoil of the firearm and to permit full gas expansion against the projectile prior to leaving the barrel of the firearm. Additionally, to prevent overthrow of the piston 33 as gas expansion occurs in the chamber 51, the receiver 20 may include a raised stop or the like 52 which acts as rear stop for the piston.

Additionally, it should be recognized that the position of the ports 32 may be almost anywhere along the barrel as long as appropriate positioning of the associated gas adjusting sleeve and piston may correlate with the ports to achieve the desired, above described results. Generally, in a pistol, the ports may be placed approximately 1¼ to 1½ inches from the bolt face.

It should be recognized that the gas system thus described will operate on virtually any firearm capable of at least semi-automatic operation, while permitting a wide variety of loads to be used by the firearm without endangerment of the operator. Additionally, the gas flow apparatus heretofore described will permit the weapon or firearm to be used in target or match type competition in a single shot mode by a simple operator adjustment. Also, because of the simple design, many parts of the firearm may be identical for different calibers, leading to interchangeability of parts and lending itself to ease in manufacture. Additionally, although the apparatus of the present invention has been, by way of example, described relative to a pistol, the present invention is equally applicable to firearms other than pistols, but are of at least semi-automatic operation.

Although the invention has been described with a certain degree of particularity, it is understood that the present disclosure has been made only by way of example and that numerous changes in the details of construction and the combination and arrangement of parts and the mode of operation may be made without departing from the spirit and the scope of the invention as hereinafter claimed.

What is claimed is:

1. A gas operated firearm capable of at least semi-automatic operation; said firearm comprising: a receiver including a barrel; a slide mounted for reciprocation on said receiver; a breech bolt mounted for reciprocation in said receiver; means coupling said bolt to said slide so that reciprocation of said slide effects reciprocation of said bolt; a plurality of radially extending ports in said barrel, an annular piston surrounding and mounted for reciprocation on said barrel, said piston including a head portion and a skirt portion extending forwardly from said head portion, said head portion being in abutment with said slide and slidable along said barrel; an annular gas flow adjuster surrounding said barrel and mounted on said barrel for movement axially therealong to any one of a plurality of different positions of adjustment relative to said barrel, said adjuster including a cylindrical sleeve slidably surrounded by said piston skirt portion, said adjuster sleeve, said head portion of said piston, and said skirt portion of said piston defining an annular gas chamber in registry with said ports, said adjuster sleeve having a rearwardly facing annular end surface defining the forward wall of said gas chamber and said head portion of said piston having a forwardly facing annular surface defining the rear wall of said gas chamber, coengageable stop means on said adjuster sleeve and on said piston for limiting forward movement of said piston relative to said adjuster to a point at which said rearwardly facing annular surface of said adjuster sleeve is spaced from said forwardly facing annular surface of said piston head portion and said adjuster sleeve having a rear end portion located adjacent said ports and which rear end portion in said different positions of adjustment of said adjuster covers different amounts of the radially outer ends of said ports to provide different degrees of restriction in the flow path of gas from the bore of said barrel to said gas chamber; and detent means for releasably holding said adjuster in any selected one of said positions of adjustment.

2. A gas operated firearm in accordance with claim 1 wherein said skirt of said piston extends forwardly from said head portion and surrounds and is axially slidable relative to a radially underlying portion of said adjuster sleeve, said coengageable stop means comprising a forwardly facing annular surface on the forward end of said piston skirt portion and a cooperating rearwardly facing annular surface at the forward end of said underlying portion of said adjuster sleeve.

3. A gas operated firearm in accordance with claim 1 wherein said piston is movable axially of said barrel independently of said slide, and including stop means for stopping the rearward movement of said annular piston before said slide reaches the rearward limit of its movement and before said skirt portion of said piston moves off of said adjuster sleeve.

4. A gas operated firearm capable of at least semi-automatic operation; said firearm comprising: a receiver including a barrel rigidly connected thereto, said barrel including a bore having a muzzle end portion and a chamber end portion and a plurality of radially extending ports through said barrel to said bore; a breech bolt mounted for reciprocation in said receiver and adapted for abutting registration in a first position with said chamber end portion; means for locking said bolt in said first position; a slide mounted for reciprocation on said receiver, said slide including a terminal end adjacent to said chamber end of said barrel; means on said slide cooperating with said bolt for unlocking the bolt and effecting reciprocation thereof when said slide reciprocates; an annular piston having a head end portion circumscribing said barrel and slidably mounted therealong, said piston also having a cylindrical skirt portion extending axially forwardly of said head end portion, which skirt portion is radially spaced from said barrel and overlies said ports, said piston being engageable with said terminal end of said slide and said skirt portion of said piston and said head end portion of said piston in part defining an annular gas chamber axially aligned with said ports and to the pressure of which gas chamber said head end portion of said piston is exposed to drive said piston axially of said barrel; an annular gas flow adjuster mounted on and surrounding said barrel for axial displacement along said barrel, said adjuster including a portion slidably surrounded by said skirt portion of said piston and which at its rear end covers various different portions of the radially outer ends of said ports to provide various different degrees of restriction in the flow path from said bore to said gas chamber depending on the axial position of said adjuster relative to said barrel, said rear end of said adjuster also defining the forward wall of said annular gas chamber; coengageable stop means on said adjuster and said piston for limiting forward movement of said piston to a point at which said head portion of said piston is spaced rearwardly from the rear end of said adjuster to give said annular gas chamber a discrete axial length; and means for releasably locking said adjuster in any one of a plurality of different axial positions relative to said barrel.

5. A gas operated firearm in accordance with claim 4 wherein said piston is movable axially of said barrel independently of said slide, and including stop means for stopping the rearward movement of said piston before said slide reaches the rearward limit of its movement and before said skirt portion of said piston moves off of said adjuster.

6. In a gas operated firearm capable of at least semi-automatic operation; the combination comprising: a barrel having an axial bore and having at one point along the length thereof at least one port extending radially through said barrel and communicating with said bore; means defining an annular gas chamber surrounding said barrel and located in axial alignment with said port, said gas chamber defining means including an annular piston surrounding and axially slidable relative to said barrel and having a head end portion with a forwardly facing annular wall, said forwardly facing annular wall of said head member being the rear wall of said annular gas chamber and being exposed to the gas pressure within said chamber for driving said piston axially of said barrel when gas under pressure is communicated to said chamber druing firing of said firearm, said gas chamber defining means also including an annular adjustment sleeve surrounding said barrel and movable axially thereof, said adjustment sleeve having an external cylindrical surface and said piston having a skirt portion extending forwardly from said head portion and having an internal cylindrical surface which slides over said cylindrical surface of said sleeve, said skirt portion having a forwardly facing stop surface at its forward end and said sleeve having a rearwardly facing stop surface coengageable therewith to limit forward movement of said piston relative to said sleeve to a point at which said gas chamber defining annular surfaces are axially spaced from one another, said adjustment sleeve having a rear end portion with a rearwardly facing annular end wall which is the front wall of said annular gas chamber, said rear end portion of said adjustment sleeve also overlying a varying amount of the outer end of said port depending on the axial position of said sleeve relative to said barrel to provide a varying degree of restriction in the flow path from said barrel bore to said gas chamber depending on the axial position of said sleeve relative to said barrel; and detent means for releasably locking said adjustment sleeve in any one of a plurality of different axial positions relative to said barrel.

7. In a gas operated firearm capable of at least semi-automatic operation; the combination comprising: a barrel having an axial bore and having at one point along the length thereof at least one port extending radially through said barrel and communicating with said bore; a slide located rearwardly of said port and slidable axially of said barrel; means biasing said slide forwardly relative to said barrel; an annular adjuster located generally forwardly of said port, said adjuster surrounding said barrel and being threadably connected therewith, said adjuster including a rear sleeve portion with a cylindrical exterior surface and a flange portion forwardly of said sleeve portion, said flange portion being of larger diameter than said sleeve portion and defining a rearwardly facing annular stop surface at the forward end of said sleeve portion, said sleeve portion having a rear end defining a rearwardly facing annular end surface and said rear end being movable axially of said barrel by threaded rotation of said adjuster relative to said barrel so as to overlie a varying amount of said port; and an annular piston surrounding said barrel and located between said flange portion of said adjuster and said slide, said piston having a head portion located rearwardly of said port and slidable axially on said barrel, said piston also having a skirt portion extending forwardly from said head portion and slidably receiving said sleeve portion of said adjuster, said head portion defining a forwardly facing annular surface, said forwardly facing annular surface of said head portion and said rearwardly facing annular surface of said adjuster sleeve portion defining respectively the rear and front walls of an annular gas chamber surrounding said barrel and with which said port communicates, said skirt portion of said piston having an annular forward end surface engageable with said annular stop surface of said adjuster to limit forward movement of said piston relative to said adjuster and said skirt portion being of such axial length that when forward movement of said piston is so limited said rear and front walls of said annular gas chamber are spaced from one another to give said gas chamber a discrete axial length.

8. A gas operated firearm as defined in claim 7 further characterized by means providing a rear stop surface fixed relative to said barrel rearwardly of said head portion of said piston and engageable therewith to limit rearward movement of said piston during firing of said firearm, said rear stop surface being so located that when engaged by said piston head portion said piston skirt portion remains axially overlapped with a part of said adjuster sleeve portion, said slide being axially slidable independently of said piston so that when rearward movement of said piston is arrested by said rear stop surface said slide may continue its rearward movement.

9. A gas operated firearm as defined in claim 7 further characterized by a spring biased detent means for releasably holding said adjuster sleeve in any selected one of a plurality of possible positions of angular adjustment relative to said barrel.

* * * * *